US006179738B1

(12) United States Patent
Perthou

(10) Patent No.: US 6,179,738 B1
(45) Date of Patent: Jan. 30, 2001

(54) FLYING TOY

(76) Inventor: Peter M. Perthou, 11 Linwood Ave., Rockport, MA (US) 01966

( * ) Notice: Under 35 U.S.C. 154(b), the term of this patent shall be extended for 760 days.

(21) Appl. No.: 08/629,991

(22) Filed: Apr. 8, 1996

Related U.S. Application Data

(62) Division of application No. 08/414,361, filed on Mar. 31, 1995, now abandoned.

(51) Int. Cl.[7] ..... A63B 65/08

(52) U.S. Cl. ..... 473/590; 446/36; 446/243

(58) Field of Search ..... 446/34, 36–46, 446/236, 243–245; 273/424–426, 428, DIG. 14; D99/27; D21/2, 82, 85, 86, 89, 91; 473/590

(56) References Cited

U.S. PATENT DOCUMENTS

| | | | |
|---|---|---|---|
| D. 31,877 | 11/1899 | Berry | D21/82 |
| D. 34,964 | 8/1901 | Stauffer | D99/27 |
| D. 139,813 | 12/1944 | Walker | D99/27 |
| D. 219,822 | 2/1971 | Rockaitis | 273/427 |
| D. 239,403 | 3/1976 | Jarvis | D34/15 PP |
| D. 342,368 | 12/1993 | Gibson | D2/227 |
| 692,608 | 2/1902 | Bristow | 446/36 |
| 1,040,702 | 10/1912 | Lee | 273/426 |
| 2,324,022 | 7/1943 | Prause, Jr. | 273/426 |
| 2,361,988 | 11/1944 | Bonnifield | 273/426 |
| 2,816,764 | 12/1957 | Gleason | 273/106 |
| 2,837,077 | 6/1958 | Frazelle | 124/16 |
| 3,107,095 | 10/1963 | Cairns | 273/425 |
| 3,403,910 | 10/1968 | Claycomb | 273/426 |
| 3,881,729 | 5/1975 | Block et al. | 273/106 |
| 3,955,817 | 5/1976 | Davis | 273/106 |
| 4,027,389 | 6/1977 | Atchisson | 30/303 |
| 4,216,962 | 8/1980 | Flemming | 273/426 |
| 4,335,537 | 6/1982 | Walker | 46/79 |
| 4,452,461 | 6/1984 | O'Brien | 273/426 |
| 4,502,219 | 3/1985 | Hibben | 30/153 |
| 4,591,164 | 5/1986 | Blight | 273/275 |
| 4,606,125 | 8/1986 | Jensen | 30/302 |
| 4,708,682 | 11/1987 | Schentrup | 446/36 |
| 4,718,874 | 1/1988 | Warren | 446/36 |
| 4,722,532 | 2/1988 | Harris | 273/426 |
| 4,772,030 | 9/1988 | Hunt | 273/426 |
| 4,817,961 | 4/1989 | Stone | 273/426 |
| 5,041,042 | 8/1991 | Stein | 446/15 |
| 5,199,717 | 4/1993 | Wimmer | 273/426 |
| 5,413,354 | 5/1995 | Miller | 273/426 |

FOREIGN PATENT DOCUMENTS

| | | | |
|---|---|---|---|
| 469000 | 12/1928 | (DE) | 446/243 |
| 2262541 | 9/1975 | (FR) | 273/426 |
| 27067 | 12/1902 | (GB) | 273/426 |
| 699214 | 11/1953 | (GB) | 273/426 |
| 718215 | 11/1954 | (GB) | 273/426 |

OTHER PUBLICATIONS

"Asian World of Martial Arts", Throwing Starts, Black Belt—15th Yearbook—1982.

*Primary Examiner*—Jacob K. Ackun
*Assistant Examiner*—Jeffrey D. Carlson
(74) *Attorney, Agent, or Firm*—Fish & Richardson PC

(57) ABSTRACT

A thin, planar flying toy has a plurality of radially extending, equiangularly spaced, relatively constant width arms extending from a central hub. Each arm has a given length that is substantially greater than the width of each of the arms. The central hub and the arms lie substantially within a common plane with the edges of the arms extending substantially perpendicularly between the first and second surfaces. The process for producing the flying toy includes cutting a planar sheet of plastic material to define the planar body that includes the central hub from which relatively constant width, equiangularly spaced arms radially extend. The material can be translucent with translucent or opaque indicia thereon to produce optically perceived patterns in flight.

2 Claims, 2 Drawing Sheets

FLYING TOY

BACKGROUND OF THE INVENTION

This is a divisional of U.S. Ser. No. 08/414,361, filed Mar. 31, 1995 now abandoned.

FIELD OF THE INVENTION

This invention relates to toys generally and more particularly to flying toys with extended arms adapted to be thrown or otherwise launched by a user.

DESCRIPTION OF RELATED ART

Flying toys are known and include boomerangs and flying disks. Generally toy boomerangs and like devices include an air foil or other aerodynamic surface that provides lift to promote the flight of the toy. The following United States Letters Patent and Design Patents and other references disclose various examples of such flying toys:

UK 27,067 (1902) Mikorey et al.

UK 699,214 (1953) Andrews

D. 31,877 (1899) Berry

D. 239,403 (1976) Jarvis

U.S. Pat. No. 1,040,702 (1912) Lee

U.S. Pat. No. 2,816,764 (1957) Gleason

U.S. Pat. No. 2,837,077 (1958) Frazelle

U.S. Pat. No. 3,403,910 (1968) Claycomb

U.S. Pat. No. 3,881,729 (1975) Block et al.

U.S. Pat. No. 4,027,389 (1977) Atchisson

U.K. Patent No. 27,067 to Mikorey et al. discloses apparatus for throwing or casting boomerangs and like projectiles. One of the projectiles is depicted as having three arms seemingly arranged equiangularly about a center axis with the outer junction of the arms defining an arc. Boomerangs and like projectiles typically include beveled edges or other airfoil type surfaces that enable the boomerang to return to the thrower. Similarly, U.S. Pat. No. 3,403,910 to Claycomb discloses a boomerang having three arms extending from a center hub with each of the arms having an airfoil shaped to provide lift during flight. U.S. Pat. No. Des. 31,877 to Berry discloses a two-arm boomerang with arms that extend from an elbow intersection.

U.K. Patent No. 699,214 to Andrews discloses a boomerang with three arms extending from a central planar hub in an offset manner so that the tips of the arms lie in a plane parallel to the plane of the hub. The hub includes inwardly arced portions between each of the arms. U.S. Pat. No. 2,816,764 to Gleason and U.S. Pat. No. 3,881,729 to Block et al. disclose one-piece flying toys with four arms extending equiangularly from a central hub. Each of the arms terminates with a bent portion that lies outside the plane of the central hub and provides both lift and stability to the flying toy during flight.

U.S. Pat. No. 2,837,077 to Frazelle discloses a spring loaded launching device that imparts both forward and angular velocity to a flying toy. The toy comprises a first and second wooden strips with rounded ends. The strips join at their respective centers with one strip lying in a first plane and the other strip lying in a second parallel plane. U.S. Pat. No. 4,216,962 to Flemming on the other hand discloses a boomerang having two convex surfaced airfoils joined at their center with one airfoil overlying the other. The ends of the Flemming boomerang curve upwardly from the center of each of the airfoils. The toy boomerang disclosed by U.S. Pat. No. Des. 239,403 to Jarvis includes a raised center hub from which four, equiangularly disposed arms extend. The arms include a reduced width portion proximate the center hub and an increased width air foil portion at the distal end of each of the arms.

U.S. Pat. No. 4,027,389 to Atchisson discloses a throwing knife having four blades that lock at their base with the blades each being in a parallel plane to the other blades. U.S. Pat. Nos. 4,817,961 to Stone and 1,040,702 to Lee both disclose flying toys that include two elongated pieces joined at their centers to define four radially extending, equiangular disposed blades. In Stone the blades also extend upwardly from the center so that the tips of the blades lie in a plane parallel with the center while Lee provides chamfered edges on each of the blades. Each of these features provide an aerodynamic surface for providing lift to these devices in their use.

These flying toys thus generally include a relatively thin body that includes at least a plurality of arms extending from a central portion. Most of the devices also include a lifting surface or other air foil arrangement to provide improved flight characteristics of such devices. That is, some have arms that extend outwardly and bend upwardly from a central hub; others have arms that are formed with a convex surface; still others have arms that include airfoil features at their ends; and still others have arms that include portions longitudinally rotated about a central hub. Yet still others require launching devices.

Each of the disclosed devices requires a plurality of steps to produce the device. That is, each requires manufacturing steps to form aerodynamic features on the arms (e.g., forming beveled edges on the arms) or to assemble the arms or to construct a toy that requires an individual to manipulate the arms prior to use so the device exhibits proper flight characteristics. For example, the flying toy disclosed by Frazelle requires the orienting of wooden strips and the securing of the strips together. The device disclosed in U.K. Patent No. 699,214 requires the bending of the arms after they are formed to provide the aerodynamic shapes. In many cases the devices are not formed from a unitary piece of material, so the individual may have to assemble the device and, in some cases, modify the device after assembly. Many of the devices, such as boomerangs that have defined upper and lower surfaces, require throwing or launching in a particular manner or orientation.

The volume of any product determines the volume of shipping containers and the display space required in a store. It is desirable to minimize these volumes. Prior art flying toys, however, due to their bulk and thickness, do not minimize such packing and display volumes.

Generally speaking, these devices fail to provide flying toys that can be easily made from a single sheet of planar material, essentially in a single step, without further manufacture or pre-use assembly or modification. Prior art devices do not provide an easily manufactured, single-piece planar flying toy with equiangularly spaced, radially extending arms that eliminates structure for enhancing lift during flight.

SUMMARY

Therefore it is an object of this invention to provide a flying toy with extending arms that is relatively easily manufactured, packaged, shipped, displayed and stored.

It is another object of this invention to provide a durable flying toy that is made of a relatively inexpensive material.

It is still another object of this invention to provide a durable flying toy that is inexpensive to manufacture.

It is yet another object of this invention to provide a flying toy that generates an optical display when used.

It is a further object of this invention to provide a flying toy that can be easily launched by a user.

It is still a further object of this invention to provide a method for manufacturing a flying toy by simply cutting the flying toy from a sheet of planar material.

According to one aspect of this invention a flying toy adapted for being thrown by a user into the air is formed of a thin planar sheet of material of substantially uniform thickness. The flying toy includes at least three arms extending radially in an equiangular fashion from a center portion of the sheet defined by the intersection of the arms. The arms and the center portion lie in substantially a single or common plane.

According to a further aspect of this invention a flying toy is produced by a process that includes the steps of providing a thin planar plastic sheet and cutting the sheet to define a plurality of equiangularly spaced arms that extend from a central hub such that the central hub and the arms including a distal or free end portion lie in substantially a common plane.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
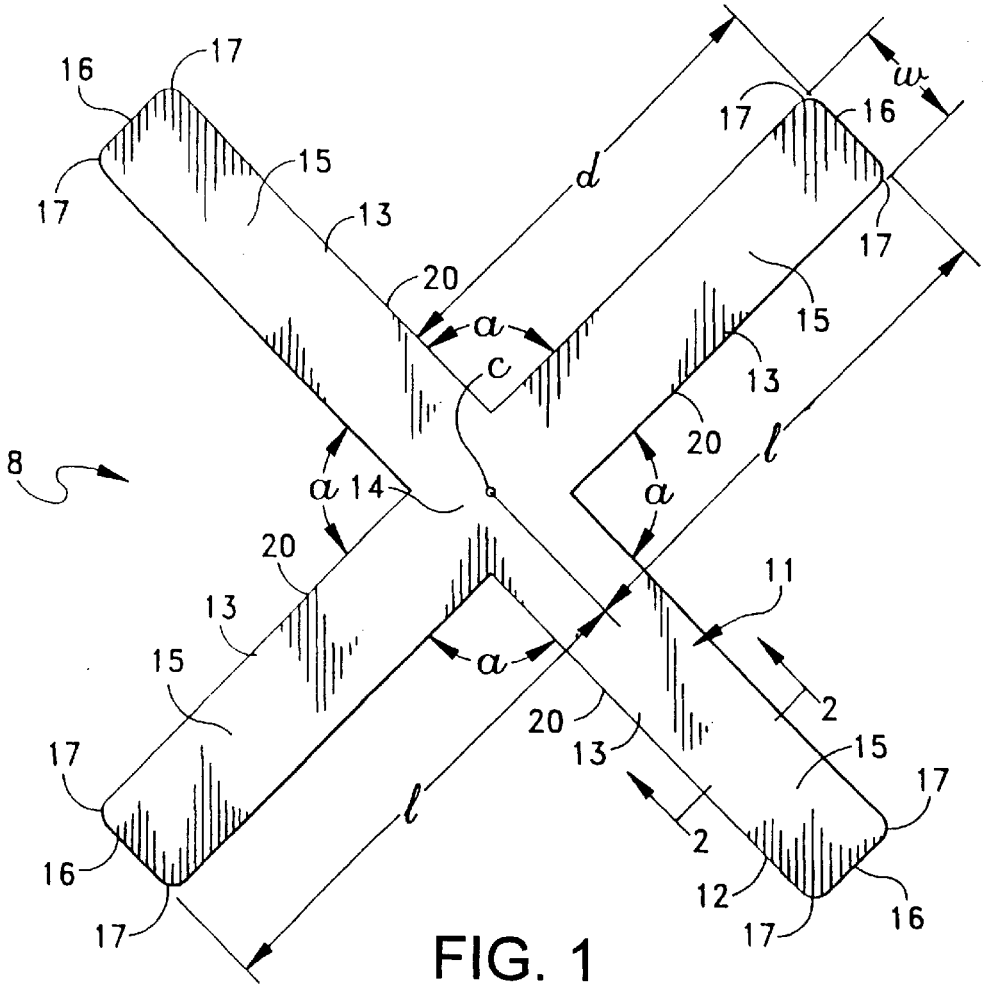
FIG. 1 is a plan view of a flying toy according to this invention.
Figure 2:
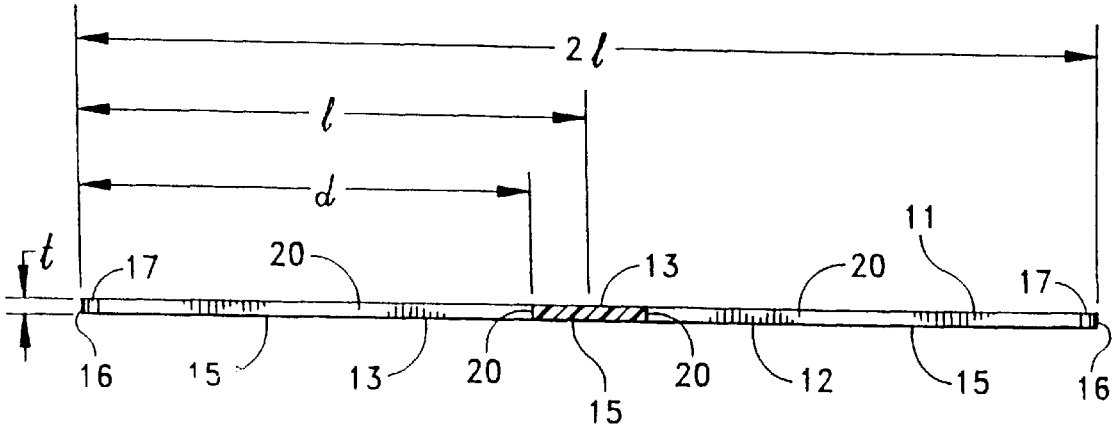
FIG. 2 is a cross-sectional view of the flying toy of FIG. 1 taken along the section line 2—2.

A flying toy 8 according to my invention comprises a substantially planar body 10 as depicted in FIG. 1 having a relatively constant, thin cross-sectional thickness t as depicted in FIG. 2 that defines spaced parallel surfaces 11 and 12. The body 10 comprises a thin, lightweight, sturdy, shatter resistant plastic sheet material, such as polyvinyl chloride. This material produces a body 10 that is sufficiently sturdy to enable the flying toy 8 to absorb stress upon any impact with other bodies and yet maintain its planar configuration in flight.

The planar body 10 includes multiple arms 13. Each arm 13 has a constant width w and extends radially from a centroid c located at a central hub 14, and the arms 13 are substantially equiangularly spaced. Each arm 13 has a length l from the centroid c and a distal portion length d that are substantially greater than the width w. Preferably each distal end 16 has rounded corners 17.

In using the flying toy 8 that incorporates this invention the user grasps the body 10 in any appropriate manner, such as by grasping one arm 13 between the user's thumb and index finger (e.g., the thumb adjacent the surface 12 and the index finger adjacent the surface 11). The user then throws the flying toy 8 by an overhand motion as used to launch a boomerang, by a sidearm as used to launch a flying disk or other motion that thrusts the flying toy 8 away from the user with rotational momentum. Even when the body 10 is thrown upwardly with the arms 13 in a substantially vertical orientation, the body 10, after being released will tend to flip to a substantially horizontal orientation after reaching a substantial height of up to 40 feet or more. Additionally, the flying toy 8 may be thrown into the wind to impart further upward motion as the body 10 moves forward through the wind.

After flying toy 8 expends its upward momentum and reaches a maximum altitude, the body 10 assumes a horizontal orientation and continues to rotate about the centroid c as it returns to earth. This motion creates an optically perceived whirling of the arms 13 during descent much like the rotation of a helicopter rotor; and the rotation continues to be observed as the flying toy 8 follows a spiraling downward path toward the ground.

The shape and features of the flying toy according to this invention provide the flying toy 8 with its ability to reach a substantial height and then gently spiral downward. Specifically, as the user launches the flying toy 8 with its thinness (t) and straight edges, the flying toy encounters negligible wind resistance to slow its trajectory or rotation. Moreover, the flying toy 8, having no lifting surface to alter its trajectory, climbs in a straight path to its apex at a substantial height. Its descent in a horizontal plane as a spinning body is a relatively slow descent due to its light weight in relation to its surface area.

Referring now to FIG. 2, an edge 20 of each arm 13 is a cut edge that extends substantially perpendicularly between the parallel surfaces 11 and 12 and is relatively blunt.

Additionally, as previously described, the arms 13 and the central hub 14 lie within a common plane. This is in contrast with the aerodynamic or lifting shapes of the edges or arrangement of blades or arms of boomerangs and other like devices of the prior art. Moreover, as the body 10 spins about the centroid c, the light weight of the body 10 and the relative rigidity of the arms 13, even though thin, causes the body 10 to gently glide to earth in a spinning motion without forming convex or concave edges or surfaces on the arms.

The flying toy according to this invention thus comprises a one-piece construction that does not require special surfaces or reorientation of the arms to provide other forms of lifting surfaces. This enables the flying toy 8 to be simply and inexpensively manufactured, as further explained below, and does not require the user to experiment to find suitable positions for the arms.

It will also be appreciated that the planar shape of the body 10 enables the flying toy 8 of this invention to be easily packaged and stored in a minimum of space. The thin planar nature of the toy 8 eliminates any need for protecting upstanding portions that characterize many of the prior art devices.

Forming the body 10 from polyvinyl chloride or other like material provides a flying toy 8 that is durable and relatively long lasting. The flying toy 8 thus can be used repeatedly without sustaining damage associated with cardboard and foam flying toys which can be easily and permanently deformed upon any impact with other objects thereby destroying the flight characteristics of such toys. Polyvinyl chloride and like materials also form light-weight toys that reduce the potential for damage posed by many of the prior art boomerangs and boomerang-like devices of greater weight.

The flying toy of this invention is not limited to use in the relatively calm conditions as typically required to fly a boomerang. The flying toy 8 has continued to exhibit its flight characteristics in winds of fifteen or more miles per hour. In fact, wind can enhance the flight characteristics by lifting the toy 8 to extend the duration of the flight due to its light weight and consequent response to updrafts.

In the disclosed embodiment of FIGS. 1 and 2, the length l of each of the arms 13 is in the range of between two to twelve times the width w of each of the arms 13 with a preferred range being three and six times the width w (i.e., $3w \leqq l \leqq 6w$). Thus, in one particular embodiment the length l is four times the width w (i.e., $l=4w$). Additionally, the width w can range between ten and fifty times the thickness t with the preferred range being approximately between twenty and thirty times the thickness t (i.e., $20t \leqq w \leqq 30t$). The dimensions of one particular flying toy that exhibits all the advantages of this invention are as follows:

l—4 inches (101.6 mm)

d—3.625 inches (92.1 mm)

w—0.75 inches (19.2 mm)

t—0.03125 inches (0.8 mm)

Thus, in this constructed embodiment the length l is slightly greater than 5 w and the width w is slightly less than 25 t. The depicted substantially equiangular orientation of the arms 13 produces a toy in which the angle a between adjacent arms 13 is approximately 90°.

Figure 3:
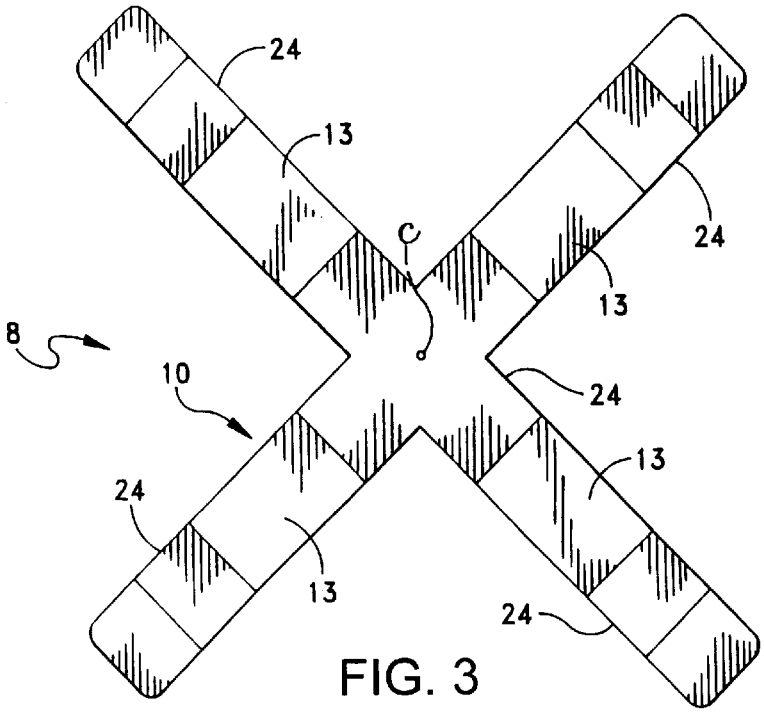
FIG. 3 is a plan view of the flying toy of FIG. 1 with indicia thereon for forming an optical pattern during flight of the flying toy.

FIG. 3 discloses a flying toy 8 as depicted in FIGS. 1 and 2 with the addition of a plurality of indicia 24 for producing optical patterns during flight. The body 10 in this instance preferably comprises optically translucent polyvinyl chloride that can be of various known light tints or hues. More opaque or opaque indicia 24 can be applied to the body 10 by known silk screen or other processes. A translucent body 10 with indicia 24 applied to one surface (e.g., surface 11) enables a person to view the indicia 24 either directly or through the other surface (e.g. the surface 12). Therefore, the indicia 24, when the body 10 spins about the centroid c, creates a visible pattern of concentric circles that can be viewed from below when the spinning body 10 assumes either of two possible horizontal orientations and is back lit from the sky. In this particular embodiment, the indicia 24 are arranged symmetrically on the arms 13. However, those skilled in the art will appreciate that other illusions or patterns can be created by appropriate combinations of asymmetrical and symmetrical indicia. It will also be appreciated that such indicia may be formed to provide advertising, such as a tradename, trademark or other logo.

The flying toy 8 of FIGS. 1 and 3 is simply constructed by cutting the body 10 from a sheet of polyvinyl chloride or similar material. Cutting is preferably accomplished by die-cutting. No further manufacturing or other process steps are required to provide a flying toy suited for use in the manner described above. If indicia are to be affixed, further silk screening or other steps will be required either prior to or after the cutting operation. Applicant believes silk screening prior to the separation step to be the most expedient.

After the flying toy 8 is manufactured, it is simply packaged by adhering the body 10 to an appropriately sized sheet of cardboard stock that can provide a display unit for merchandizing. Moreover, the final package saves space because individual flying toys can be conveniently stacked for shipment, storage and display. In this manner, the flying toy 8 according to this invention promotes ease in the manufacture, shipping, handling, storage and display of the device as compared with the prior art.

Figure 4:
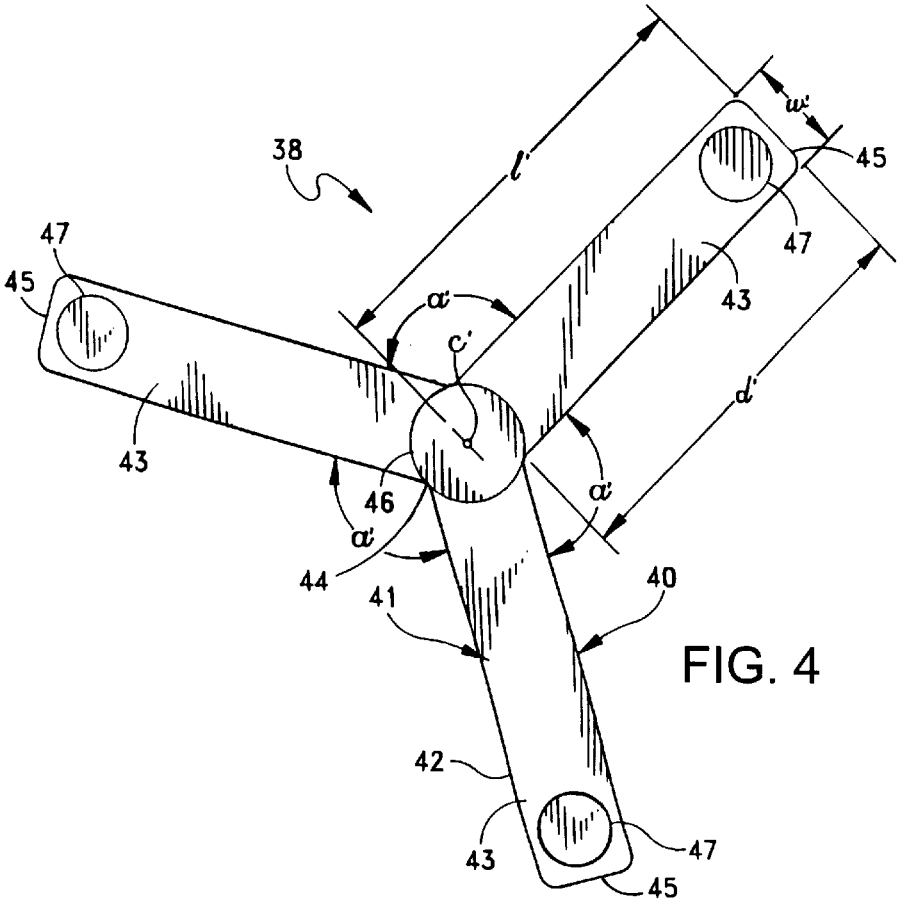
FIG. 4 is a plan view of another embodiment of a flying toy according to this invention.

Referring now to FIG. 4, another flying toy 38 according to this invention comprises a planar body 40 having a thickness t' (not shown) disposed between opposed parallel surfaces 41 and 42. Three substantially equiangularly disposed radially extending arms 43 extend a distance l' from a centroid c' in a central hub 44. The arms 43 extend equiangularly from the hub 44 (i.e., at approximately 120°) and terminate at distal ends 45. The relative ranges for length, width and thickness of this embodiment correspond with the ranges discussed with respect to the embodiment of FIG. 1. Additionally, the arms 43 in this embodiment may include indicia 24 as shown in FIG. 3 or, as shown in FIG. 4, a center indicia 46 and outer indicia 47 in the form of translucent or opaque circles.

In summary, boomerangs and related prior art devices are winged flying objects that include an airfoil to provide lift upon rotation of the flying object and to cause the device to take a curved path through the air. A flying toy in accordance with this invention is unlike a boomerang since it has no airfoils. The flying toy is stamped in one piece from a planar sheet of plastic. It has at least three arms extending radially in an equiangular fashion from a center portion of the sheet defined by the intersection of the arms. The plastic provides lightness, rigidity, and a wing thickness of as little a 0.025".

Despite its relatively low mass and momentum as compared to boomerangs and like devices, the thin wing structure of the present invention minimizes air resistance and makes it possible for the device to reach heights of up to 40 feet when thrown upwardly at a sharp angle and to be thrown a considerable distance in a straight line. Minimal air resistance also permits extended rotation time while its relative lightness allows a slow descent. If the body is formed of translucent plastic with colored indicia arranged in one or more symmetrical patterns, on the wings, the toy creates a circular illuminated optical illusion as it rotates during its descent. In addition, the device's light weight, unbeveled edges, and rounded wing tips produce a flying toy that can be used by children and adults in most ambient conditions.

Thus, a flying toy in accordance with this invention includes a planar body formed from a thin, light-weight, rigid material that includes a plurality of equiangularly spaced arms that radially extend from a central hub. The arms have blunt edges. The arms and the central hub lie in a common plane. The flying toy does not include aerodynamic surfaces to provide lift and can be thrown in any orientation, unlike a boomerang that requires an individual to throw it in a particular manner and orientation. The flying toy, once separated from its packaging is ready to fly without further manipulation or adjustment of the arms and central hub. The flying toy also provides the visual impression of a helicopter wing rotating in flight and can further include other indicia to provide other displays.

It will be understood that various modifications can be made to the disclosed invention that are contemplated within the invention. For example, those skilled in the art will understand that in some cases that it may be desired to change the width of the arms as they extend from the central hub. The arms can be made with a bulbous end portion as viewed from above or below the planar surface. In such cases, the flying toy could be silk-screened to appear like a flower with the illusion produced by rotation of the arms defining the petals thereof. In any event the thickness and the planar features of the invention would not be changed.

Thus, although this invention has been disclosed in terms of certain embodiments, it will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A method for producing a flying toy comprising the steps of:

A. providing a thin planar sheet of relatively rigid plastic; and

B. cutting the flying toy from the sheet along planes substantially perpendicular to the plane of the sheet to produce a unitary planar flying toy having a plurality of equiangularly spaced arms extending from a central hub defined by the intersection of said arms to distal end portions, each arm having a length substantially greater than its width, said cutting step maintaining the resulting flying toy in a single plane and said method producing a flying toy that is devoid of any airfoil shaped surface; and C. forming visible indicia on the sheet wherein said sheet comprises translucent polyvinyl chloride plastic such that the indicia form an optically perceived pattern upon spinning the flying toy.

2. A method for producing a flying toy comprising the steps of:

A. providing a thin planar sheet of relatively rigid plastic; and cutting the flying toy from the sheet along planes substantially perpendicular to the plane of the sheet to produce a unitary planar flying toy having a plurality of equiangularly spaced arms extending from a central hub defined by the intersection of said arms to distal end portions, each arm having a length substantially greater than its width, said cutting step maintaining the resulting flying toy in a single plane and said method producing a flying toy that is devoid of any airfoil shaped surface; and C. wherein said sheet comprises translucent polyvinyl chloride plastic, said method further comprising the step of forming visible indicia on the sheet prior to said cutting step such that the indicia form an optically perceived pattern upon spinning the flying toy.

* * * * *